US009039012B2

(12) United States Patent
O'Sullivan

(10) Patent No.: US 9,039,012 B2
(45) Date of Patent: May 26, 2015

(54) TRAINING DEVICE

(76) Inventor: John Joe O'Sullivan, Cork (IE)

( * ) Notice: Subject to any disclaimer, the term of this patent is extended or adjusted under 35 U.S.C. 154(b) by 1149 days.

(21) Appl. No.: 12/067,247

(22) PCT Filed: Sep. 14, 2006

(86) PCT No.: PCT/EP2006/008957

§ 371 (c)(1),
(2), (4) Date: Mar. 18, 2008

(87) PCT Pub. No.: WO2007/039056

PCT Pub. Date: Apr. 12, 2007

(65) Prior Publication Data

US 2008/0246221 A1 Oct. 9, 2008

(30) Foreign Application Priority Data

Sep. 19, 2005 (IE) ..... S2005/0617

(51) Int. Cl.

| | |
|---|---|
| ***A63B 63/00*** | (2006.01) |
| ***A63B 69/00*** | (2006.01) |
| ***A63B 69/40*** | (2006.01) |
| *A63B 24/00* | (2006.01) |

(52) U.S. Cl.

CPC ..... *A63B 63/004* (2013.01); *A63B 63/00* (2013.01); *A63B 69/002* (2013.01); *A63B 69/40* (2013.01); *A63B 2024/004* (2013.01); *A63B 2024/0043* (2013.01); *A63B 2063/001* (2013.01); *A63B 2243/0025* (2013.01); *A63B 2243/0033* (2013.01)

(58) Field of Classification Search

CPC ..... A63B 63/004; A63B 2243/0025; A63B 2024/0037; A63B 69/40

USPC ..... 273/348, 355–358, 396, 399, 405, 408, 273/410

See application file for complete search history.

(56) References Cited

U.S. PATENT DOCUMENTS

| | | | | | |
|---|---|---|---|---|---|
| 4,163,941 | A * | 8/1979 | Linn, Jr. | ..... | 324/178 |
| 4,915,384 | A * | 4/1990 | Bear | ..... | 473/451 |
| 5,133,548 | A * | 7/1992 | Bedord et al. | ..... | 473/436 |
| 5,573,239 | A * | 11/1996 | Ryker et al. | ..... | 473/436 |
| 5,649,706 | A * | 7/1997 | Treat et al. | ..... | 273/358 |
| 5,658,211 | A * | 8/1997 | Glover | ..... | 473/422 |
| 5,816,953 | A * | 10/1998 | Cleveland | ..... | 473/459 |
| 5,951,015 | A * | 9/1999 | Smith et al. | ..... | 273/358 |
| 6,155,936 | A * | 12/2000 | Dorr | ..... | 473/456 |
| 6,526,861 | B1 * | 3/2003 | Gruber | ..... | 273/410 |
| 6,641,139 | B2 * | 11/2003 | Lamberti et al. | ..... | 273/378 |
| 7,878,890 | B2 * | 2/2011 | Toyohara et al. | ..... | 463/3 |
| 2001/0056000 | A1 * | 12/2001 | Hori | ..... | 473/453 |

* cited by examiner

*Primary Examiner* — Steven J Hylinski

(74) *Attorney, Agent, or Firm* — Michael J. Feigin, Esq.; Feigin & Associates, LLC

(57) ABSTRACT

A training device for installation in a practice area is provided, the training device providing an indication to a user as to where on a first surface of the training device a football should be aimed. The first surface is configured to allow the ball to pass through the first surface, where it is collected and returned to the user. The training device is also configured to indicate to the user approximately where in the practice area the football will be returned to, so as to allow the user to position themselves accordingly.

32 Claims, 8 Drawing Sheets

TRAINING DEVICE

The present invention relates to a training device, in particular to a device for improving accuracy with a ball.

It has long been known that basic skill and technique with a ball can be improved through increased practice of kicking the ball. The exercise of kicking a ball against a wall or flat surface has been used for many years as a starting point for the development of ball control, accuracy, and technique. However, as players become more experienced, it is to their advantage to be put through a more demanding and sophisticated training procedure. This is sometimes done through the use of dedicated training devices.

A number of different training devices are described in WO99/07447, WO96/17658, US05556/06, GB2323297 and JP10015138. However, none of these devices fully meets the needs of a modern player in providing a comprehensive test of accuracy, technique, movement, and stamina. Also, modern training techniques require the monitoring of a player's development, firstly during a single training session, and also over an extended period of time, encompassing a number of separate training sessions.

The present invention provides a training device for installation in a practice area comprising:

a main body, a first surface supported by said main body, having a target face exposed to a user of said training device, a ball firing mechanism, and a visual return indicator operatively connected to the ball firing mechanism, wherein said training device is operable to display a target at a location on said first surface where it is desired that a user propel a ball, and said visual return indicator is operable to display a return target indicating a particular location within the practice area that the ball firing mechanism will fire a ball towards.

Preferably, said training device comprises ball return target projector operable to project a target at a location on said first surface where it is desired that the user propel a ball.

Preferably, said first surface comprises a translucent sheet.

Preferably, said ball return target projector is supported by said main body and is juxtaposed a surface of said translucent sheet opposite said target face.

Preferably, said first surface comprises a resilient plastic material.

Alternatively, said first surface comprises a cushioned surface.

Preferably, said resilient plastic material comprises a least one strip extending freely from said main body, wherein said at least one strip acts to retard the momentum of said ball, while allowing said ball to pass.

Preferably, said training device comprises a sensor element, operable to detect a location on said first surface where said ball hits said first surface.

Preferably, said training device comprises a plurality of sensor elements disposed around said first surface.

Preferably, said sensor elements comprise sensors selected from a group including optical, inertia and pressure sensors.

Preferably, said training device comprises a processor, operable to provide a comparison between said location on said first surface where it is desired that a user propel said ball and said location on said first surface where said ball hits said first surface.

Preferably, said training device comprises a timer operable to measure a duration between the time of display of said target at a location on said first surface where it is desired that said user propel a ball, and the time when a ball is detected hitting said first surface.

Preferably, said training device comprises data storage means adapted to store at least one of said comparison and said duration.

Preferably, said training device comprises a controller coupled to said ball return target projector, said controller being operable to vary said location on said first surface where it is desired that said user propel said ball.

It will be seen that such embodiments of the invention provide a training device that tests each of the above-mentioned qualities, combined a monitor a player's progress while using the device.

Preferably, the training device is arranged to deliver a ball to said user.

Preferably, said training device comprises an adjustable barrel and a ball propulsion mechanism for propelling a ball through said barrel.

Preferably, said barrel is adjustable to direct the delivery of said ball to said user.

Preferably, said barrel is tiltable along its vertical axis, by a vertical tilt angle.

Preferably, said barrel is tiltable along its horizontal axis, by a horizontal tilt angle.

Preferably, said ball propulsion mechanism is arranged to propel said ball at variable speeds.

Preferably, said training device includes a reservoir to store a plurality of balls.

Preferably, said training device comprises wind speed measuring means to record wind speed in the vicinity of the device.

Preferably, said training device comprises wind direction measuring means to record wind direction in the vicinity of the device.

Preferably, said processor is operable to predict a target location where a ball fired by said ball propulsion mechanism will initially land, wherein said prediction is a function of at least one of said force imparted by said impelling mechanism, said vertical tilt angle, said horizontal tilt angle, said recorded wind speed, said recorded wind direction, or a combination thereof.

Preferably, said training device comprises ball delivery target projector coupled to said processor and operable to project a target onto a surface corresponding to said target location where a ball fired from said ball delivery mechanism will initially land.

Preferably, said ball delivery target projector comprises a moveable light source.

Preferably, said ball delivery target projector comprises a laser projector.

Preferably, said training device includes a ball collector to collect a ball.

Preferably, said ball collector comprises a chute.

An embodiment of the invention will now be described, by way of example, with reference to the following drawings, in which.

Figure 1:
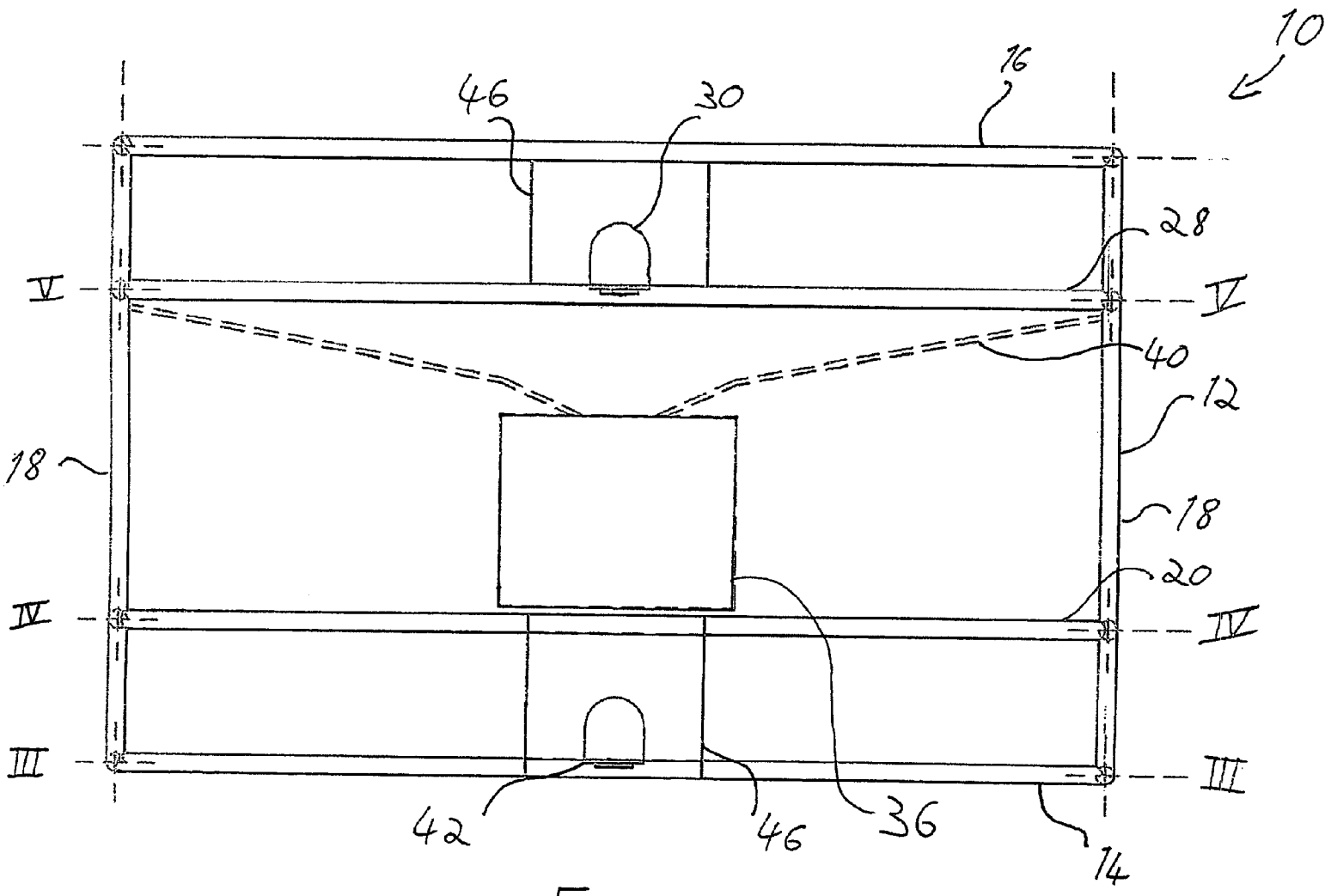
FIG. 1 is a top plan view of a training device according to a first embodiment of the invention.

A training device as according to the invention is indicated generally at 10. The training device 10 comprises a support structure 12, comprising a forward vertically disposed U-shaped frame having a bridge 14, a rear vertically disposed U-shaped frame having a bridge 16, and a pair of supporting members 18 connecting respective ends of the bridges 14,16 so that the support structure 12 forms a rectangular box-like frame.

An intermediate sensor frame 20 is located on the support structure 12, between the front and rear frames towards the front frame. A plurality of sensor elements, a sample of which are indicated at 22, are positioned about the sensor frame 20, FIG. 3. The sensor elements 22 are operable to detect an object (for example, a ball) passing through the sensor frame 20, and are connected to a processor (not shown) in order to provide X and Y co-ordinates for the point at which the object passes through the sensor frame 20. The specific X and Y co-ordinates for this point shall be hereinafter referred to as the Return Location.

In the present embodiment, an array of laser light sensors are used, wherein the breaking of one or more of laser beams of the array causes the sensors to detect the passing through of an object, but it will be understood that other sensors, such as ultrasonic or inertia sensors, may be used without departing from the scope of the invention.

Resilient rectangular plastics strips 24 are attached to the sensor frame 20. The strips 24 hang freely from a top member of the sensor frame 20 and extend substantially from the top member to the ground.

In the preferred embodiment, the sensor elements are located out of the plane of the strips 24 and between the strips and the front frame, so that a ball passing through the strips actuates the sensors before a deflected strip. The strips 24 act to kill/retard the momentum of a ball that passes through the sensor frame 20 immediately after its Return Location has been detected by the sensor elements 22.

Referring to FIG. 1, an intermediate projector frame 28 is located on the support structure 12 between the rear frame and the sensor frame 20. A rear light source 30 is mounted on the projector frame 28. The rear light source 30 is rotatable so that the light source 30 can project a first target 32 onto any location on the resilient strips 24, FIG. 3.

This first target 32 is indicative of a location for a user of the training device 10 to propel a ball. The specific X and Y co-ordinates for this point shall be hereinafter referred to as the Target Location. The rear light source 30 is controlled by the processor, which varies the positioning of the Target Location.

In this embodiment, the strips 24 are translucent, to allow the first target 32 to be seen from a position on the opposite side of the sensor frame 20. However, it will be understood that other configurations may be used. For example, the rear light source 30 may alternatively be mounted on the first frame 14, and project a target onto the front facing surface of the strips 24. One consequence of such an embodiment is that the resilient strips 24 need not be translucent.

Figure 4:
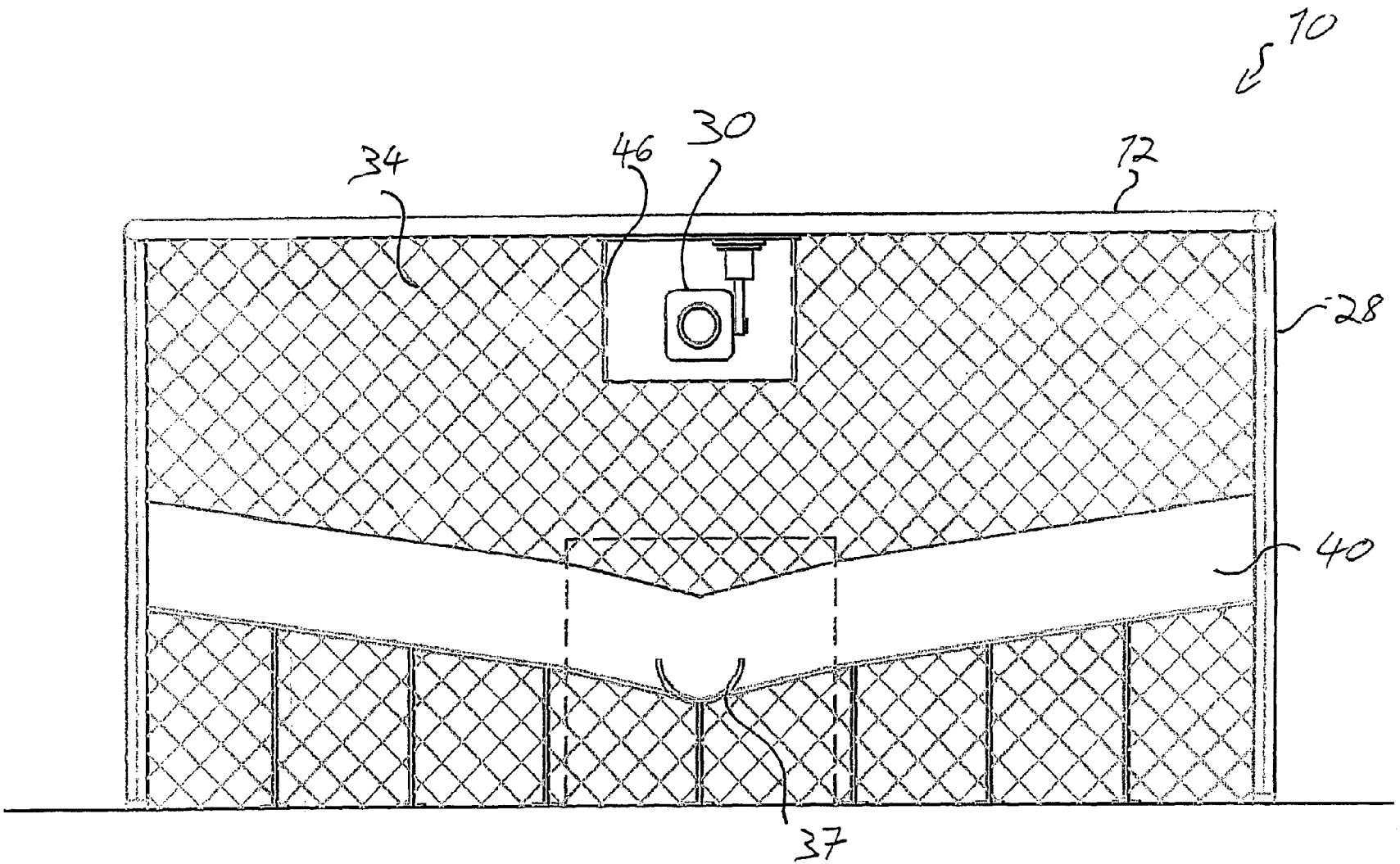
FIG. 4 is a cross-sectional view of the training device of FIG. 1, taken along the line V-V.

In order to prevent a ball from exiting the confines of the training device 10 after it has passed through the sensor frame 20, a rear net 34 is located across the face of the rear frame, FIG. 4. Three further nets (not shown) are located between the front and rear frames forming a substantially goal-like structure.

It will be understood that other materials may be used in place of a net, for example flexible plastics sheets, or a cushioned surface.

Figure 3:
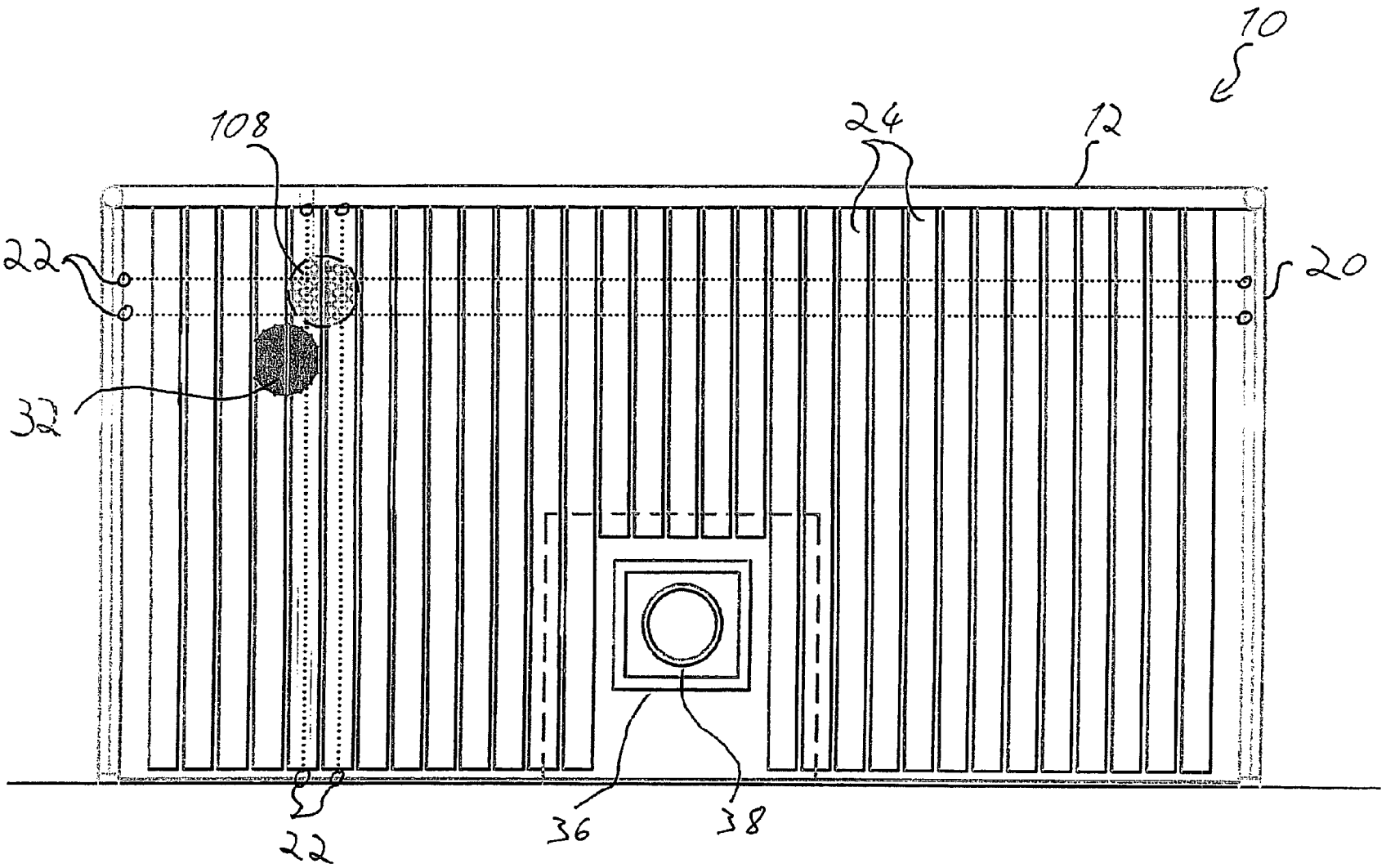
FIG. 3 is a cross-sectional view of the training device of FIG. 1, taken along the line IV-IV.

Referring to FIG. 3, a ball propulsion mechanism 36 is mounted on the base of the sensor frame 20. The ball propulsion mechanism 36 comprises an adjustable barrel 38. The barrel 38 faces towards the front frame, forming an open side of the training device 10. The ball propulsion mechanism 36 is effective to propel a ball through the barrel 38 out of the training device 10. As the barrel 38 is adjustable, both the vertical and horizontal angle of fire can be varied.

It will be also understood that in the ball propulsion mechanism 36 the power/speed that the ball is fired at can be varied, as well as the spin placed on the ball. The ball propulsion mechanism 36 may comprise any suitable machinery operable to effect the firing of a ball through the barrel 38, for example a hydraulic hammer-type device, or compressed air.

Referring back to FIG. 4, in the present embodiment, an inclined surface 40 is provided within the training device 10 to the rear of the ball propulsion mechanism 36. The inclined surface 40 slopes down towards the ball propulsion mechanism 36, the mechanism 36 further comprising a ball collection chute 37 to gather a ball at the rear of the mechanism 36 for firing.

In use, a ball that is propelled through the resilient strips 24 will be stopped by the net 34 and fall to the inclined surface 40, where it will roll towards the ball propulsion mechanism 36 and be collected by the chute 37 for firing out of the training device 10. The ball propulsion mechanism 36 may further comprise an internal reservoir (not shown) of balls stored for firing.

Referring back to FIG. 1, a front light source 42 is mounted on the first frame 14. The front light source 42 is rotatable, and is operable to project a delivery target 44 onto the ground in front of the training device 10. The front light source 42 is controlled by the processor so that the movement of the delivery target 44 is coordinated with the area on the ground that a ball to be fired from the ball propulsion mechanism 36 is aimed towards. This allows a user of the training device 10 to see the planned trajectory of a ball about to be fired, and to run to position himself to return the ball to the training device 10.

Preferably, the processor is able to predict where the delivered ball will land as a function of the power/speed that the ball is fired and the direction of the barrel 36 when the ball is fired. Other factors, such as wind speed and wind direction may also be taken into account when determining where the ball will land in order to provide a more accurate prediction.

Both the rear light source 30 and the front light source 42 are encased in a toughened transparent casing 46 to prevent damage to the light sources 30,42 from returned balls.

Figure 2:
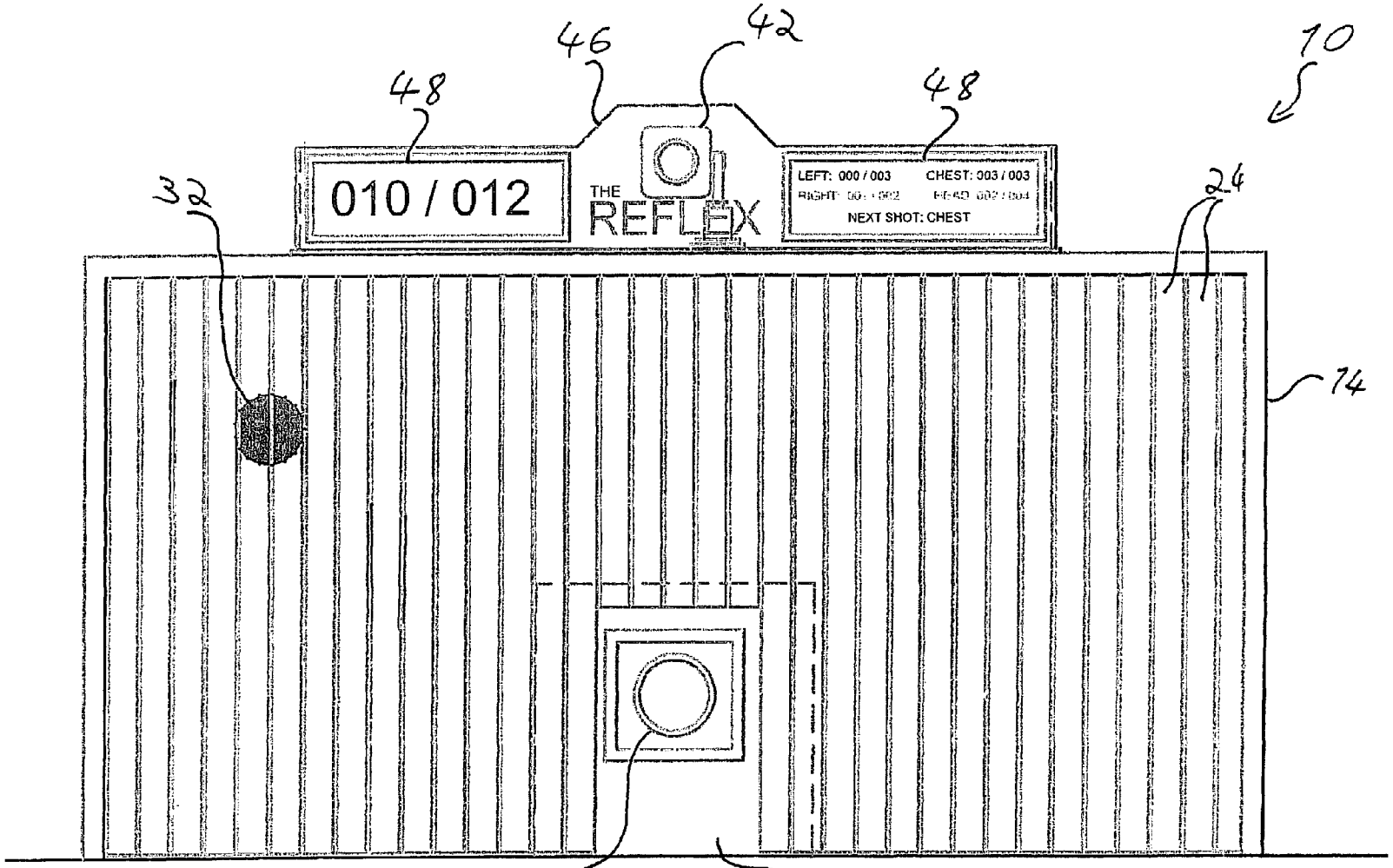
FIG. 2 is a cross-sectional view of the training device of FIG. 1, taken along the line III-III.

As can be seen from FIG. 2, the training device 10 further comprises a display device 48 mounted on the first frame 14. The display device 48 is connected to the processor to project information about the training session. The information may be about for example accuracy (difference between Target Location and Return Location), details about the next ball to be propelled towards the user (whether it is to be returned by right foot, left foot, head, whether it is a high or low ball etc.), breakdown of performance (how much more accurate were returns from the right foot as opposed to the left foot). The training device may also comprise an audio output (not shown) to provide audio cues to the user as to how to return the ball, or audio updates on the users performance.

The training device may also comprise an input device (not shown) connected to the processor to input an identifier unique to each separate user. The input device may also be operable to input training patterns. For example, the user may input a particular training pattern that they wish to follow (for example, focusing on the left leg), or may desire a random training pattern. Also, a supervisor (such as a trainer or coach) may be able to program particular training patterns for particular users. For example, a trainer may wish for an attacker to concentrate on shooting with both feet, while he may wish for a defender to practice heading the ball.

The processor may further comprise a data storage device, operable to store the results of different users' performance. The data storage device may also be operable to record a set of results for a particular user, which can then be analysed by the processor to show the progress made by that user after a number of training sessions.

The training device may further comprise an output device to produce summaries of the user's performance during the training session, or after a number of sessions. The summaries may be displayed on a screen, may be copied to a removable storage device for later access, or may be printed out in hardcopy form.

It will be understood that the training device may be operatively coupled with a mobile device (e.g. a laptop computer, a PDA, a mobile phone handset, etc) to control the programming and/or the operation of the training device.

Figure 5:
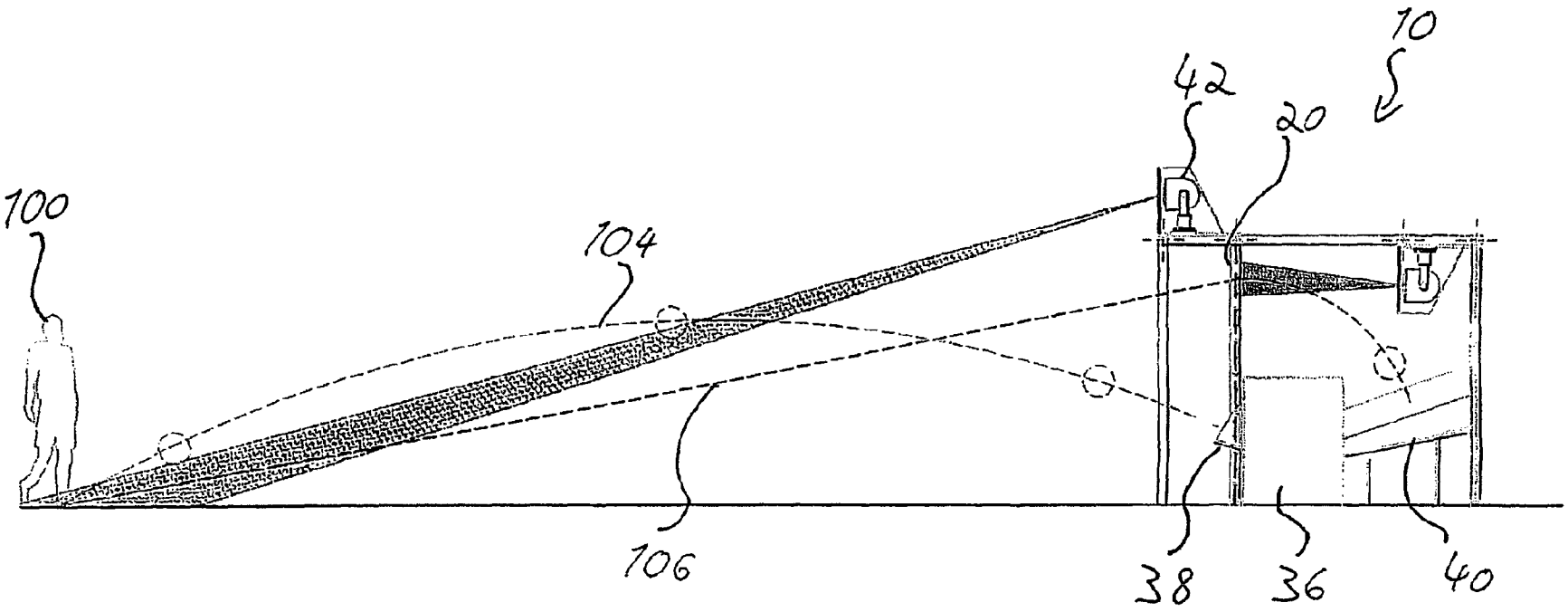
FIG. 5 is a side view of the training device of FIG. 1 in use.
Figure 6:
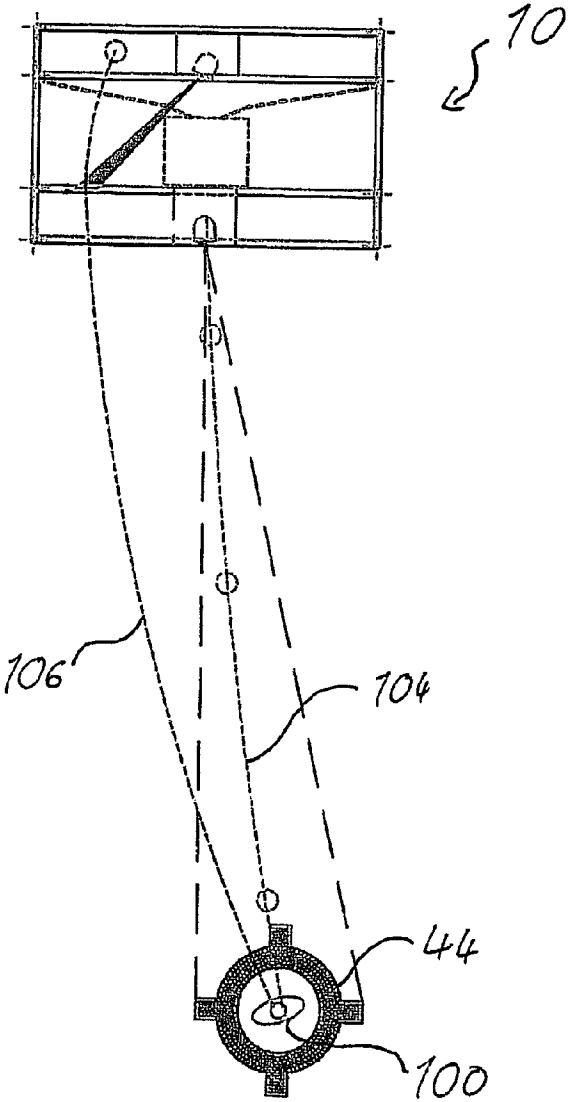
FIG. 6 is a top plan view of the training device of FIG. 1 in use.

The training device 10 in operation can be seen from FIGS. 5 and 6 in particular. A user 100 of the device enters into the input device their unique identifier, and the particulars of a training program that they wish to follow. They then take up position in front of the device 10.

The processor determines where a ball is to be fired, how it should be fired (hard/soft shot, type of spin etc.), the method of return to the device (left leg, right leg, head etc.), and where it is desired to aim the ball—the Target Location 32. Consequently, the processor updates the display device 48 to show how the next shot is to be returned.

The processor also controls the rear light source 30 to project a target 32 onto the resilient strips 24 at a location corresponding to the Target Location. This enables the user 100 to see where to aim the returned ball towards.

The processor then controls the ball propulsion mechanism 36 to fire the ball towards the user 100. As the barrel 38 is in the process of aiming, the front light source 42 is updated with the location where the ball is to be fired towards, and projects the delivery target 44 onto the ground at a location corresponding to where the ball is aimed towards. This allows the user 100 to manoeuvre themselves into a position to return the ball.

Allowing a small delay so that the user 100 can move into position, the ball propulsion mechanism 36 fires a ball in the direction of the delivery target 44 (dashed line 104). The user 100 then returns the ball towards the device 10 using that part of the body they are instructed to use (dashed line 106).

Once the ball passes through the sensor frame 20, its presence is detected by the sensor elements 22 arranged around the sensor frame 20. The location that the ball passes through the sensor frame 20 corresponds to the Return Location 108. The X and Y co-ordinates of the Return Location 108 are sent to the processor for comparison with the desired Target Location 32. A representation of the accuracy of the returned ball may be displayed on the display device 48, and may be written to the data storage device for later access.

The ball then hits the resilient strips 24 positioned adjacent to the sensor elements 22. The strips 24 kill the momentum of the ball, while simultaneously allowing it to pass through. The ball then drops down onto the inclined surface 40 for collection by the ball collection chute 37 for re-firing. It will be understood that a plurality of balls may be used by the device 10, to minimise the delay between successive operations of the device 10.

Once the ball has been returned, the processor proceeds to update the next instance of ball delivery. The device 10 can be set up to operate for a fixed number of ball deliveries, or alternatively a fixed period of time.

It will be understood that the distance balls are delivered to and the frequency of the deliveries may vary depending on various factors, for example the skill of the user or the vigorousness of the training regimen chosen.

Figure 7:
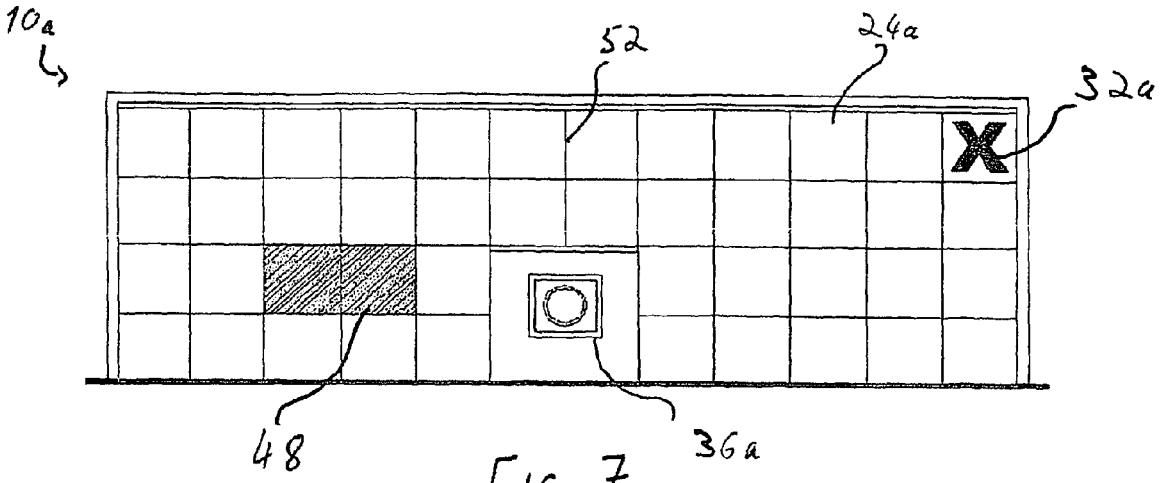
FIG. 7 is a front plan view of a training device according to a second embodiment of the invention.
Figure 8:
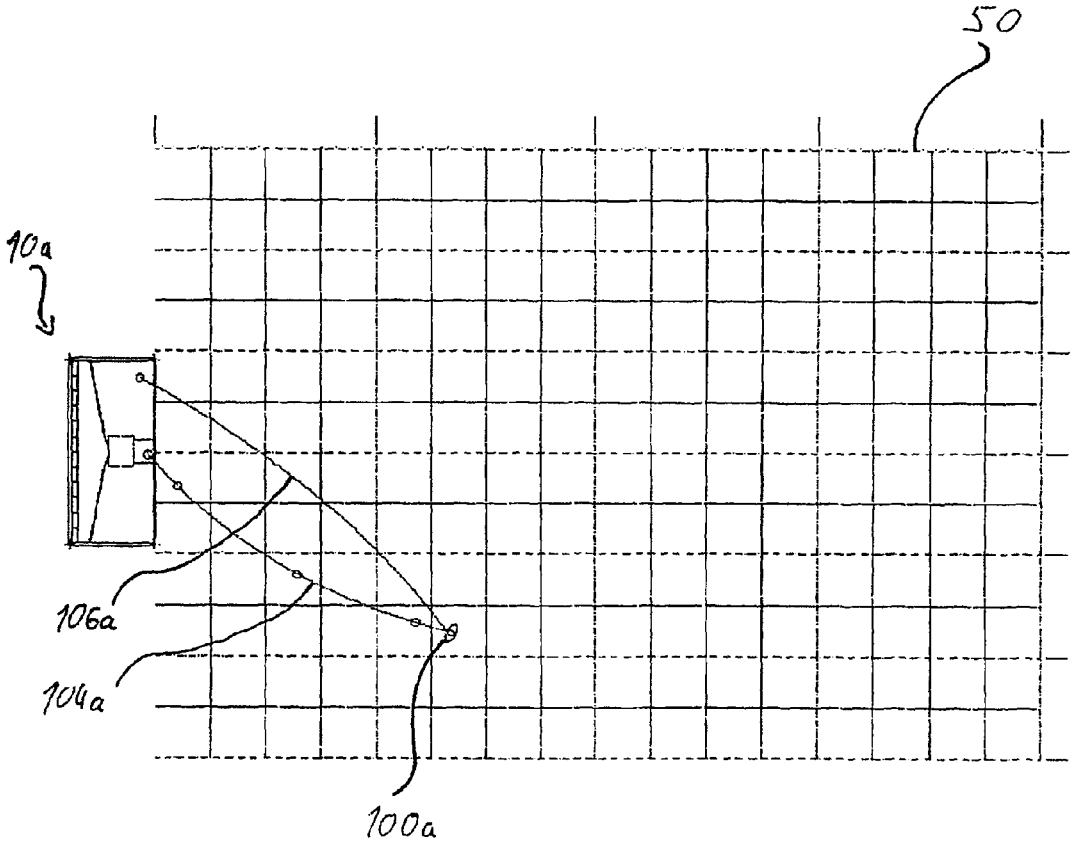
FIG. 8 is a top plan view of the training device of FIG. 7 in use.

Referring to FIGS. 7 and 8, an alternative embodiment of the training device 10 is shown, having alternative delivery target prediction. The configuration of the device **10*a* is similar to the primary embodiment of the training device 10, and the corresponding components are indicated by an appended 'a' to the numeral. The alternative training device 10*a* is suitable for use in conditions where the delivery target 44** of the first embodiment may not be easily seen, for example in strong sunlight.

Instead of using a front light source 42 to illuminate a delivery target 44 on the ground, the training device **10*a* comprises a delivery indicator light source (not shown), which is mounted at the rear of the training device 10*a*, similar to how the rear light source (not shown—equivalent to rear light source 30** in the first embodiment) is mounted.

The delivery indicator light source is operable to project a predicted delivery target 48 onto the rear of the resilient plastic strips (indicated generally by **24*a*). In this embodiment, the exposed surface of the resilient strips 24*a* is taken to be representative of the practice area in front of the training device 10*a*. A user of the training device 10*a* is able to see a graphical projection on the resilient strips 24*a* that corresponds with a location on the ground where a ball fired from the training device 10*a*** is aimed towards.

As with the rear light source 30 of the first embodiment, the delivery indicator light source is controlled by the processor, so that the location on the resilient strips **24*a* that the predicted delivery target 48 is projected onto corresponds with and is coordinated with the predicted location that a ball to be fired from the ball propulsion mechanism 36*a*** is aimed towards.

As can be seen from FIG. 7, the resilient strips **24*a* can be divided into a visual grid 52, which serves to indicate easily to a user of the training device 10*a*** what location of the practice area that the ball to be fired is aimed at.

Referring to FIG. 8, a sample practice pitch outline 50 is shown. Here, the practice area is divided into a plurality of sections that correspond to the areas of the grid 52 represented on the resilient strips **24*a*. The pitch outline 50** may be marked out using standard pitch lining techniques, or may be defined through the use of flags, training cones, or other standard training tools.

As shown in FIGS. 7 and 8, an example usage of the training device **10*a* is shown. The processor instructs the delivery indicator light source and the rear light source to project a first target 32*a* and the predicted delivery target 48 onto the resilient strips 24*a*. The user 100*a* of the training device 10*a* is able to position themselves at the location on the practice pitch outline 50 corresponding to the predicted location that the ball will be fired from the training device 10*a*. Once the user 100*a* is in a position to receive the ball, they can prepare themselves to return the ball to the location indicated by the first target 32***a*. In FIG. 8, the ball delivery path is indicated by 104*a*, while the ball return path is indicated by 106*a*.

It will be understood that the resolution of the predicted delivery target 48, the grid 50, the practice pitch outline 50 etc. may be altered depending on the difficulty of the training program selected, current atmospheric conditions, accuracy of the ball propulsion mechanism 36*a* etc.

While the present embodiments use resilient plastics strips to retard the ball momentum, other embodiments may employ different retarding means, for example flexible nets, to trap the ball.

Further enhancements to the device may incorporate an image recorder so that a player's movement and returns of the ball may be monitored, and possibly stored for later analysis. This may facilitate the checking that a player is returning the ball in the correct manner (e.g. with the left foot when instructed to return with the left). It also may allow a trainer to suggest to a player possible improvements to their movement or technique. The image recorder may comprise one or more video cameras coupled to a central processor. The image recorder may be located on the training device itself, or may be positioned at various locations about the extremity of the practice area.

Figure 9:
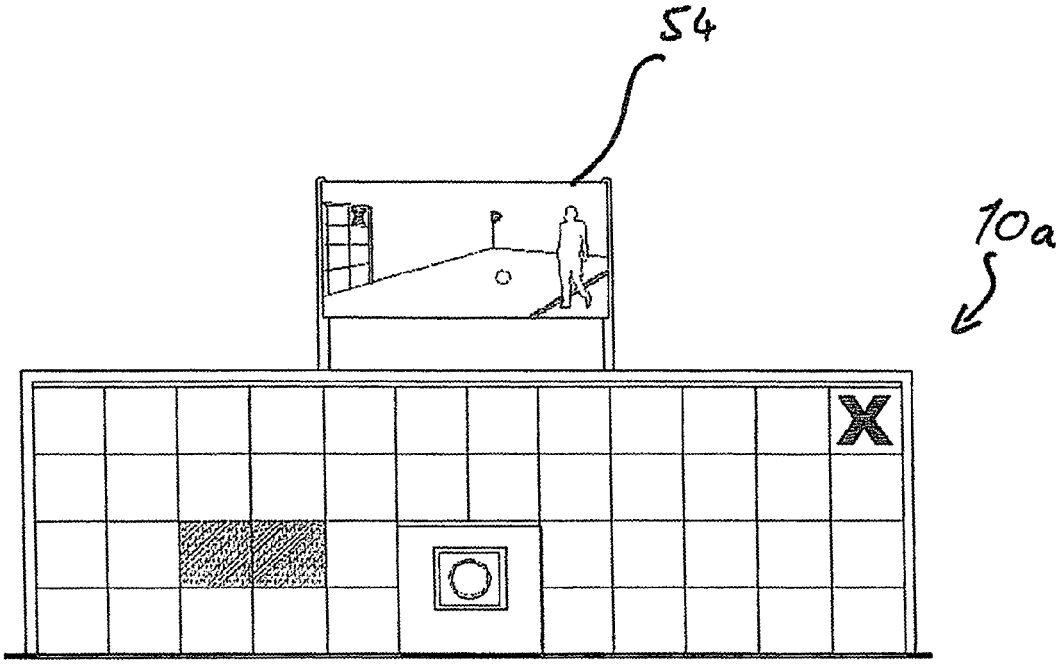
FIG. 9 is a front plan view of the training device of FIG. 7 having a secondary display screen.

Referring to FIG. 9, a further improvement can be made to the training device 10*a* through the addition of a secondary display screen 54. The display screen 54 is mounted on top of the training device 10*a*. The display screen 54 is coupled to the image recorder and a central processor, and is operable to display images captured by the image recorder. The image recorder can also be coupled to storage media, to allow recorded passages of play to be stored for later access and analysis. It will be understood that the display screen 54 may display images in real-time, or may show a replay of a sequence of video that has been recorded.

Use of the display screen 54 allows a user of the training device 10*a* to themselves analyse their shooting technique during a training session.

Figure 10:
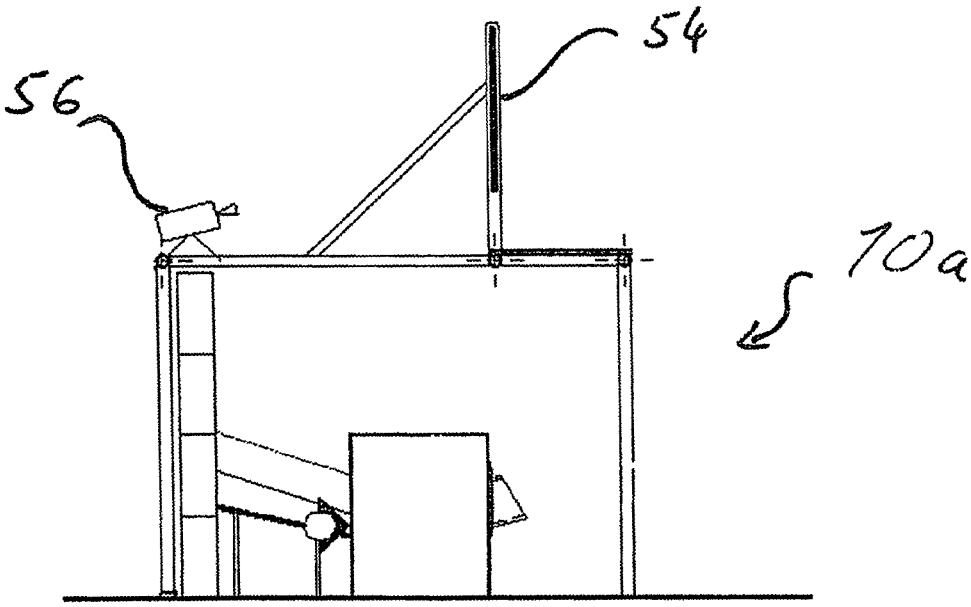
FIG. 10 is a side plan view of the training device of FIG. 9.

It will be understood that the display screen 54 may be in the form of any conventional display technology, e.g. LCD screen, cathode-ray tube etc. In FIG. 10, a version of the display screen 54 is shown wherein the display is produced by way of a rear projector 56 mounted on the training device 10*a*, the display screen 54 in this instance being made from a semi-translucent material. The rear projector 56 is operable to project images onto the display screen 54, so that the images can be viewed by a user of the training device 10*a* from the practice area.

While the display screen 54 is shown in FIGS. 9 and 10 as being mounted on the training device 10*a* of the second embodiment, it will be understood that the display screen 54 is not limited to use with the second embodiment, and can quite easily be adapted to be used with the training device 10 of the first embodiment.

While the present embodiment describes a training apparatus directed towards a football player, it will be understood that the device could be easily adapted for players of other sports disciplines e.g. handball, netball, gaelic football, hurling, etc.

The invention is not limited to the embodiments described herein, and may be modified or adapted without departing from the scope of the present invention.

The invention claimed is:

1. A training device for installation in a practice area comprising:

a main body, a first surface supported by said main body, having a target face exposed to a user of said training device, a ball firing mechanism, and a visual return indicator operatively connected to the ball firing mechanism, wherein said training device is operable to display a delivery target at a location on said first surface where it is desired that a user propel a ball, and said visual return indicator is operable to display a firing target indicating a particular location within the practice area that the ball firing mechanism will fire a ball towards;

wherein said first surface comprises a resilient plastic material and wherein said resilient plastic material comprises at least one strip extending freely from said main body, wherein said at least one strip acts to retard the momentum of said ball, while allowing said ball to pass.

2. The training device of claim 1, wherein said training device comprises a target projector, the target projector operable to project a delivery target at a location on said first surface where it is desired that a user propel a ball.

3. The training device of claim 2, wherein said first surface comprises a translucent sheet.

4. The training device of claim 3, wherein said target projector is supported by said main body and is juxtaposed a surface of said translucent sheet opposite said target face.

5. The training device of claim 2, wherein said training device comprises a target controller coupled to said target projector, said controller being operable to vary said location on said first surface where it is desired that said user propel said ball.

6. The training device of claim 1, wherein said first surface comprises a cushioned surface.

7. The training device of claim 1, wherein said ball firing mechanism comprises an adjustable barrel and a ball propulsion mechanism for propelling a ball through said barrel.

8. The training device of claim 7, wherein said barrel is adjustable to direct the delivery of said ball to said user.

9. The training device of claim 8, wherein said barrel is tiltable along its vertical axis, by a vertical tilt angle.

10. The training device of claim 8, wherein said barrel is tiltable along its horizontal axis, by a horizontal tilt angle.

11. The training device of claim 7, wherein said ball propulsion mechanism is arranged to propel said ball at variable speeds.

12. The training device of claims 9, 10, or 11, wherein said training device comprises a ball return controller, the ball return controller being coupled to said visual return indicator, the ball return controller operable to predict a target location where a ball fired by said ball propulsion mechanism will initially land, wherein said prediction is based on a function of any one of the force imparted by said impelling mechanism, the vertical tilt angle, the horizontal tilt angle, or a combination thereof.

13. The training device of claim 12, wherein said visual return indicator comprises a moveable light source.

14. The training device of claim 13, wherein said visual return indicator is supported by said main body and is juxtaposed a surface of said translucent sheet opposite said target face.

15. The training device of claim 12, wherein said visual return indicator is operable to project a firing target on said first surface.

16. The training device of claim 12, wherein said visual return indicator is operable to project a firing target on the surface of said practice area.

17. The training device of claim 1, wherein said particular location can include a sector of the practice area, or a line along which the ball will be returned.

18. The training device of claim 1, wherein said training device comprises a sensor element, operable to detect a location on said first surface where said ball hits said first surface.

19. The training device of claim 18, wherein said training device comprises a plurality of sensor elements disposed around said first surface.

20. The training device of claim 19, wherein said sensor elements comprise sensors selected from a group including optical, inertia and pressure sensors.

21. The training device of claim 1, wherein said training device comprises a processor, operable to provide a comparison between said location on said first surface where it is desired that a user propel said ball and said location on said first surface where said ball hits said first surface.

22. The training device of one of claim 21 or claim 24, wherein said training device comprises data storage means adapted to store at least one of said comparison or said duration, or both.

23. The training device of claim 21, wherein said processor is coupled to said target controller and to said ball return controller, the processor operable to vary the operation of the target controller and the ball return controller.

24. The training device of claim 23, wherein the processor is coupled to a removable mobile device, said device allowing the training device to be controlled by an operator of the mobile device.

25. The training device of claim 24, wherein the mobile device is one of a laptop computer, a Personal Digital Assistant (PDA), a mobile phone handset.

26. The training device of claim 1, wherein said training device comprises a timer operable to measure a duration between the time of display of said target at a location on said first surface where it is desired that said user propel a ball, and the time when a ball is detected hitting said first surface.

27. The training device of claim 1, wherein said training device includes a reservoir to store a plurality of balls.

28. The training device of claim 1, wherein said training device includes a ball collector to collect a ball propelled at the training device.

29. The training device of claim 28, wherein said ball collector comprises a chute.

30. The training device of claim 1, wherein the training device further comprises image recording means and image storage means, the image recording means being operable to record a video feed of a user of the training device when the training device is in use, and the storage means being operable to store the video feed.

31. The training device of claim 30, wherein the training device further comprises secondary display means, the secondary display means being coupled to the image recording means and the image storage means, the secondary display means being operable to display the stored video feed.

32. The training device of claim 31, wherein the secondary display means comprises a display screen, the display screen being mounted on the training device.

* * * * *